United States Patent [19]

Janosko et al.

[11] 4,233,694

[45] Nov. 18, 1980

[54] SPA CONSTRUCTION AND ISOLATED CONTROLS THEREFOR

[75] Inventors: Richard L. Janosko, Oakland; Ralph D'Innocente, Pleasant Hill, both of Calif.

[73] Assignee: Jacuzzi Whirlpool Bath, Inc., Walnut Creek, Calif.

[21] Appl. No.: 5,627

[22] Filed: Jan. 22, 1979

[51] Int. Cl.[3] ..... E04H 3/18; A47K 3/00; F24H 1/10; H01H 9/00

[52] U.S. Cl. ..... 4/542; 210/169; 219/296; 335/207; 4/544; 4/546; 4/590; 4/493; 4/509; 4/512

[58] Field of Search ..... 335/207; 4/173 R, 179, 4/180, 175, 177, 172, 172.15–172.17, DIG. 14, 146; 219/316, 327, 296; 210/169, 184, 186; 128/66

[56] References Cited

U.S. PATENT DOCUMENTS

| | | | |
|---|---|---|---|
| 2,355,693 | 8/1944 | Aldrich | 210/184 X |
| 3,138,153 | 6/1964 | Osborn et al. | 4/180 X |
| 3,209,297 | 9/1965 | Kmiecik | 335/207 X |
| 3,591,872 | 7/1971 | Vanegas | 4/180 X |
| 3,669,297 | 6/1972 | Willinger | 210/169 |
| 3,693,194 | 9/1972 | Schindler | 4/172.17 |
| 3,943,580 | 3/1976 | Carter | 4/172.15 |
| 3,952,338 | 4/1976 | Troxclair | 4/172.15 |
| 4,025,885 | 5/1977 | Giannini | 335/207 X |
| 4,150,665 | 4/1979 | Wolfson | 4/179 X |
| 4,154,679 | 5/1979 | Farage | 4/172.17 X |

FOREIGN PATENT DOCUMENTS

| | | | |
|---|---|---|---|
| 941936 | 11/1963 | United Kingdom | 4/179 |

*Primary Examiner*—Stuart S. Levy

*Attorney, Agent, or Firm*—Flehr, Hohbach, Test, Albritton & Herbert

[57] ABSTRACT

A spa construction for use by humans comprising a shell for containing water and having a well for receiving the feet of the user. A seat is provided adjacent the well upon which the user can sit. A side wall is provided against which the user can rest his back. A first pump is provided having an inlet coupled into the bottom portion of the shell for withdrawing water from within the shell and an outlet coupled to the shell above the seat for introducing jets of water into the shell. An air inlet is provided for mixing air into the jets of water introduced into the shell. A filter and heater housing is carried by the shell and has disposed therein filter and heater elements. An additional pump is provided having an inlet coupled to the shell for drawing water from the shell into the filter and heater housing and discharging the same through an outlet coupled to the shell. Electrically isolated controls carried by the shell are accessible to the user from within or without the shell for controlling the first and second pumps and the heater elements.

14 Claims, 12 Drawing Figures

FIG-1
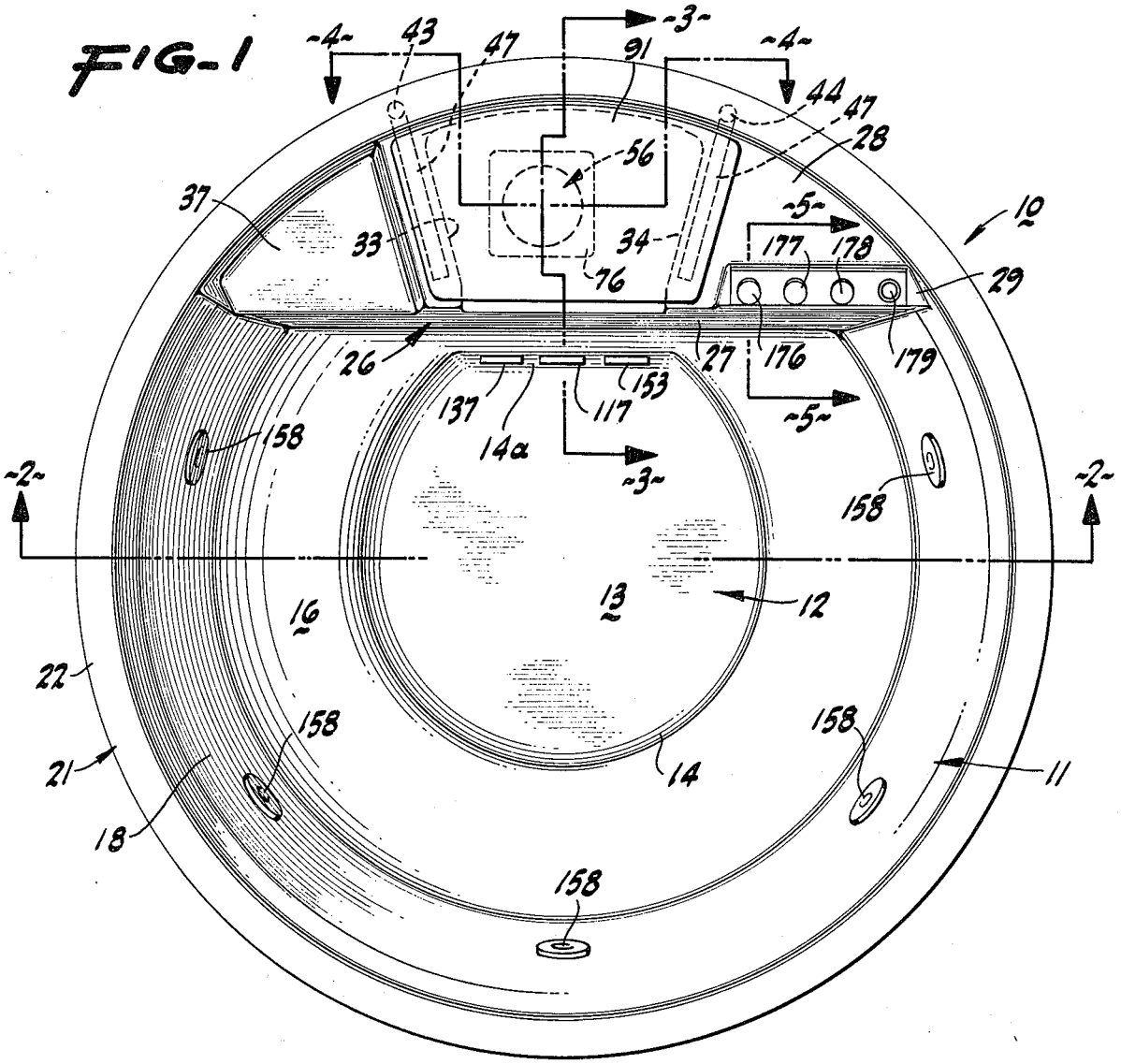
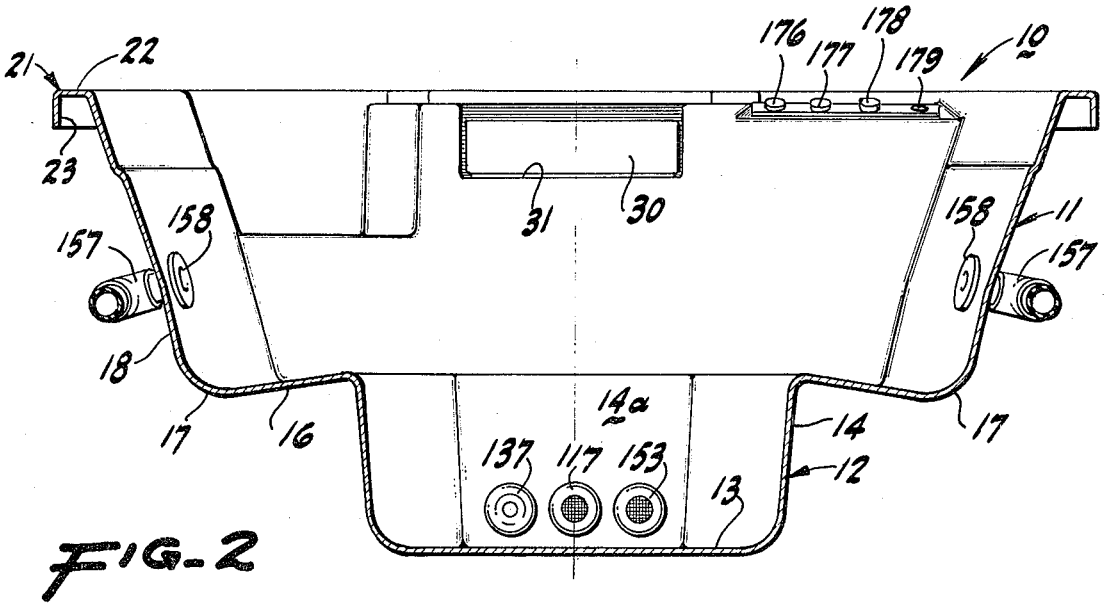
FIG-2

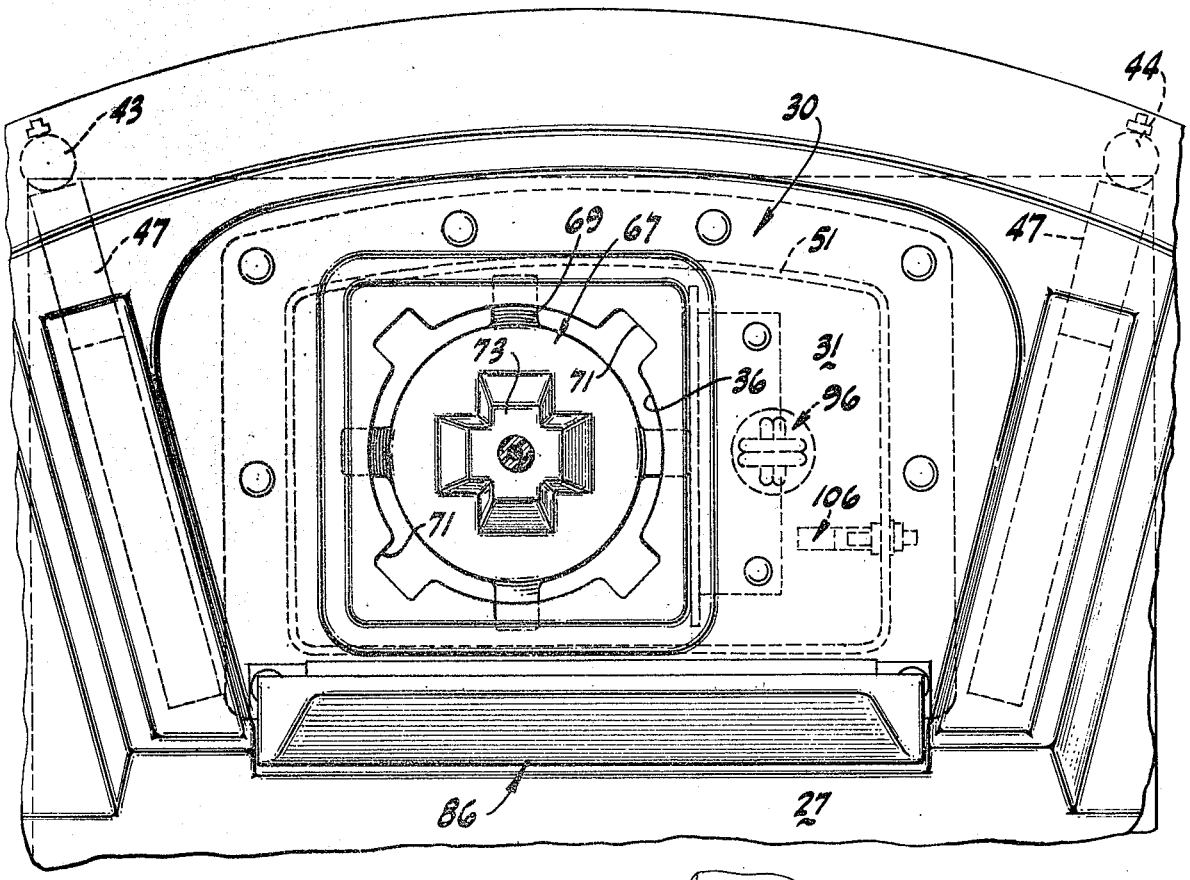
FIG-7
FIG-6
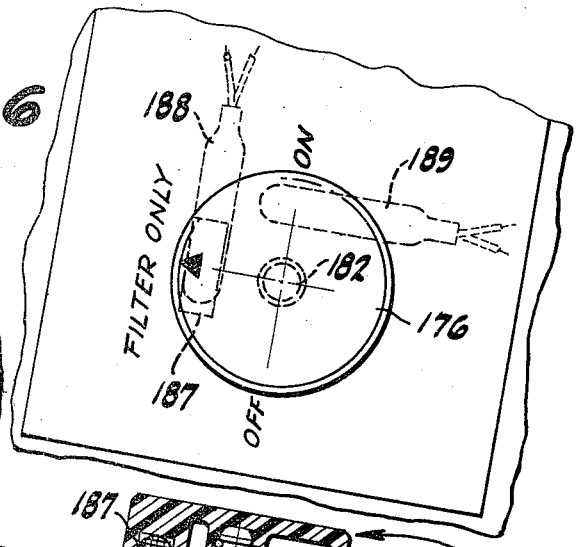
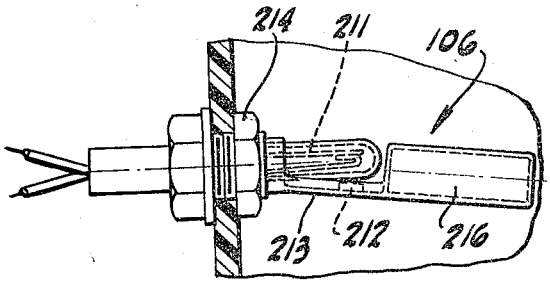
FIG-8
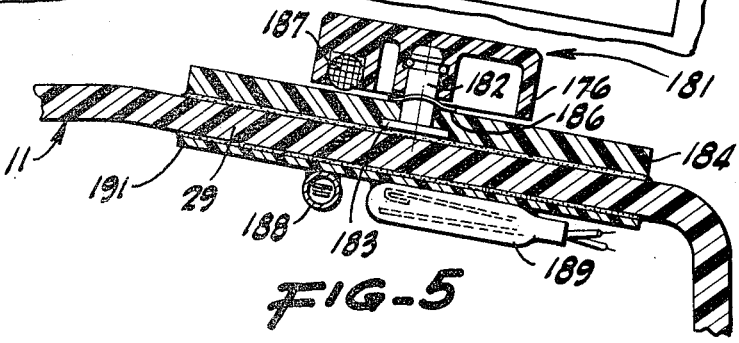
FIG-5

FIG-9
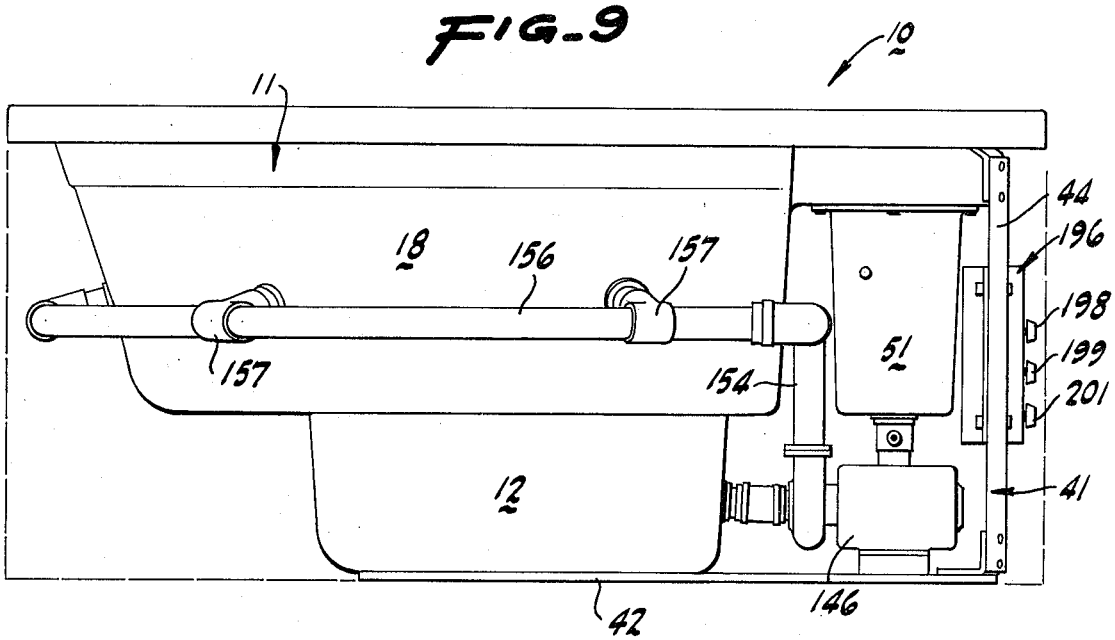
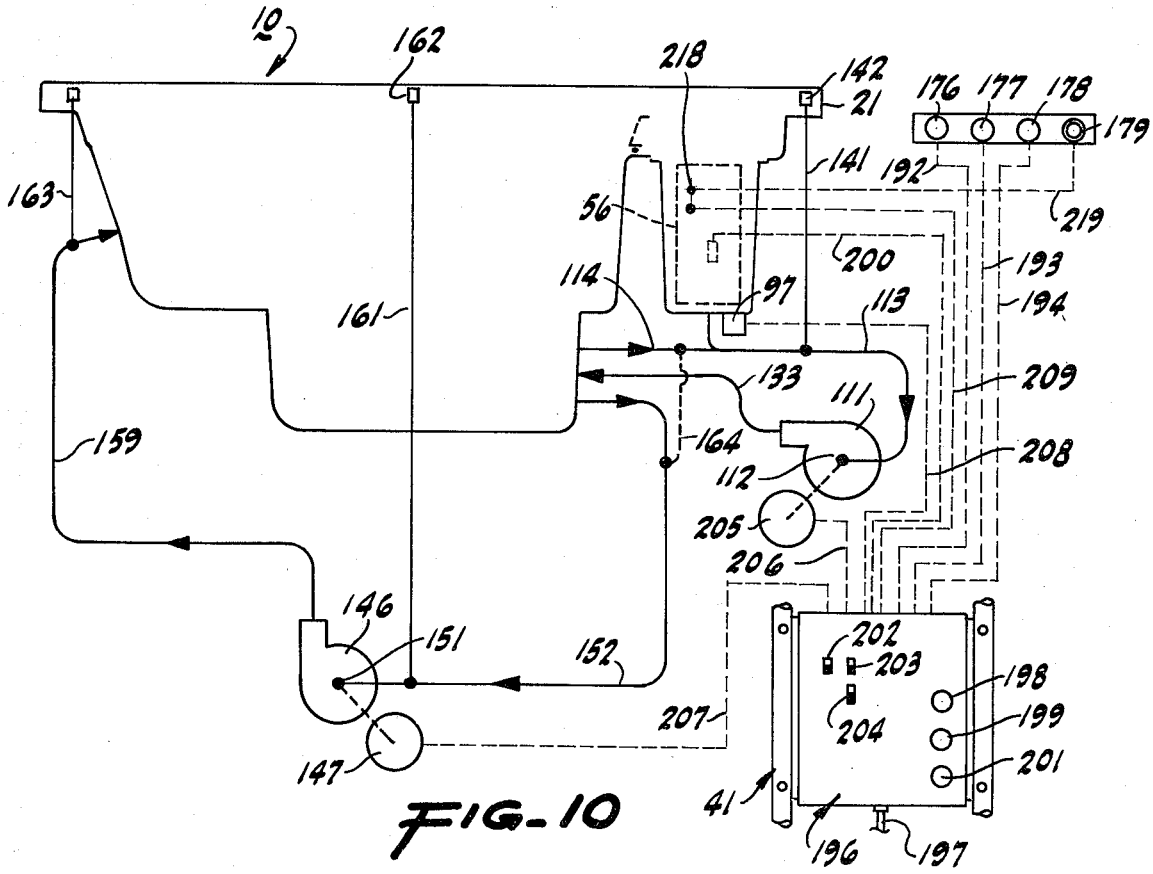
FIG-10

SPA CONSTRUCTION AND ISOLATED CONTROLS THEREFOR

This invention relates to a spa construction and to controls for use therewith which are electrically isolated.

Spas have heretofore been provided having various types of construction. However, in general such spas have been relatively heavy and bulky with separate heaters, filters, motors, pumps and piping. In addition, with such spas it has been the practice to provide controls which are inaccessible to the user when the user is within the spa. There is therefore a need for a new and improves spa construction and controls therefor which overcome these difficulties.

In general, it is an object of the present invention to provide a spa construction which can be readily installed in residences with a minimum of construction and cost to the purchaser.

Another object of the invention is to provide a spa construction of the above character with isolated dashboard controls which make possible full operation of the spa from the interior or the exterior of the spa, either to initiate its functions or to modify them.

Another object of the invention is to provide a spa construction of the above character which can be readily maintained.

Another object of the invention is to provide a spa construction in which the heater and filter units utilized therein are formed integral therewith.

Another object of the invention is to provide a spa construction of the above character which can be readily installed by the residential owner.

Another object of the invention is to provide a spa construction of the above character which is essentially a self-contained unit.

Additional objects and features of the invention will appear from the following description in which the preferred embodiments are set forth in detail in conjunction with the accompanying drawings.

In summary, the spa construction which is for use by humans comprises a shell for containing water and having a well for receiving the feet of the user. A seat is provided adjacent the well upon which the user can sit. A side wall is provided against which the user can rest his back. A first pump is provided having an inlet coupled into the bottom portion of the shell for withdrawing water from within the shell and an outlet coupled to the shell above the seat for introducing jets of water into the shell. An air inlet is provided for mixing air into the jets of water introduced into the shell. A filter and heater housing is carried by the shell and has disposed therein filter and heater elements. An additional pump is provided having an inlet coupled to the shell for drawing water from the shell into the filter and heater housing and discharging the same through an outlet coupled to the shell. Electrically isolated controls carried by the shell are accessible to the user from within or without the shell for controlling the first and second pumps and the heater elements.

FIG. 1 is a top plan view of a spa construction incorporating the present invention.

FIG. 2 is a cross-sectional view taken along the line 2—2 of FIG. 1.

FIG. 5 is a cross-sectional view taken along the line 5—5 of FIG. 1.

FIG. 6 is a top plan view of the switch construction shown in FIG. 5.

FIG. 7 is a partial top plan view showing in particular the filter and heater housing construction with the top cover removed.

FIG. 8 is a view partly in cross-section showing a float switch assembly utilized in the spa construction.

FIG. 9 is a side elevational view of the spa construction.

FIG. 10 is a schematic illustration of the spa construction with its associated control circuitry.

Figure 3:
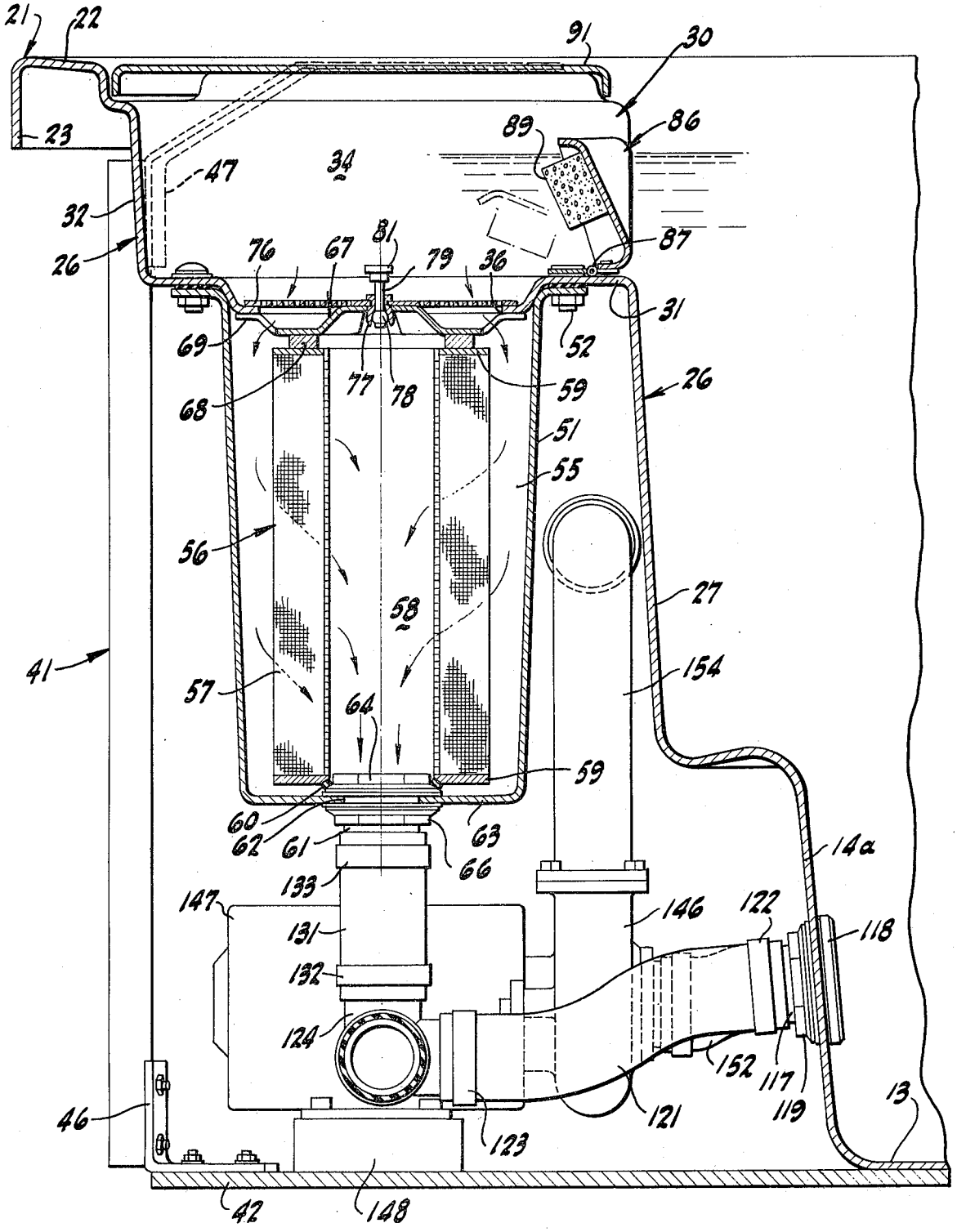
FIG. 3 is a cross-sectional view taken along the line 3—3 of FIG. 1.

The spa construction 10 which is shown in FIGS. 1–11 of the drawings consists of a shell 11 formed of a fiberglass reinforced plastic such as polyester resin or of acrylic plastic reinforced with fiberglass reinforced resin plastic. The shell is contoured in a particular manner to provide a centrally disposed foot well 12 which is formed by a generally planar bottom surface 13 and a vertical generally cylindrical wall 14 except one portion **14*a* thereof which is generally planar. The shell 11 is also provided with a generally planar circular portion 16 adjoining the well 14 and lying in a generally horizontal plane, It extends outwardly therefrom and slightly downwardly as shown particularly in FIG. 3. The planar circular portion 16 adjoins a circular curved portion 17 which adjoins an upwardly and outwardly extending side wall portion 18. The well 12 in combination with the generally planar portion 16, the curved portion 17 and the side wall portion 18 provide contoured seating around the perimeter of the shell. In other words, seats or seating are provided in the shell 11 which are sufficient for a number of human beings. The side wall portion 18 adjoins a rim 21 formed by a circular planar portion 22 and a depending lip 23**.

The shell 11 is provided with a sector-shaped portion 26 which is formed by a front vertically extending planar wall 27 that is disposed slightly to the rear of the vertically extending wall portion **14*a* forming the well 12 (see FIG. 1). The wall 27 adjoins a generally horizontal top wall 28 which extends vertically from the wall 27 and adjoins the rim 21. The top wall 28 is provided with a recessed panel 29 for controls as hereinafter provided adjacent one end of the wall 27. A skimmer 30 is formed in the top wall 28 and has its lower extremity defined by a generally horizontal wall 31, upwardly rear wall 32 and side walls 33 and 34. The bottom wall 31 is provided with a centrally disposed opening 36. A step 37 is provided in the top wall 28. The step 37 is recessed and is provided with a suitable non-skid surface so that the user can utilize the step 37 in stepping down onto the seat provided by the planar portion 16 and then down into the well 12**.

The shell 11 has a framework 41 secured thereto. The framework 41 consists of a planar member 42 formed of a suitable material such as a sheet of plywood which has been treated so that it is water repellent. The member 42 is secured to the bottom side of the shell 11 in the vicinity of the well 12 by suitable means such as an adhesive. The member 42 extends to the rear of the shell 11 so that it underlies the sector-shaped portion 26. A pair of vertical pipes 43 and 44 is provided. The lower extremities of the pipes 43 and 44 are secured to the member 42 by brackets 46. Similarly the upper ends of the pipes 43 and 44 are secured by brackets 47 to the upper extremity of the shell 11 beneath the rim 21.

The framework 41 provides a support for equipment associated with the shell 11 and also provides a support for shipping the shell as hereinafter described.

Figure 4:
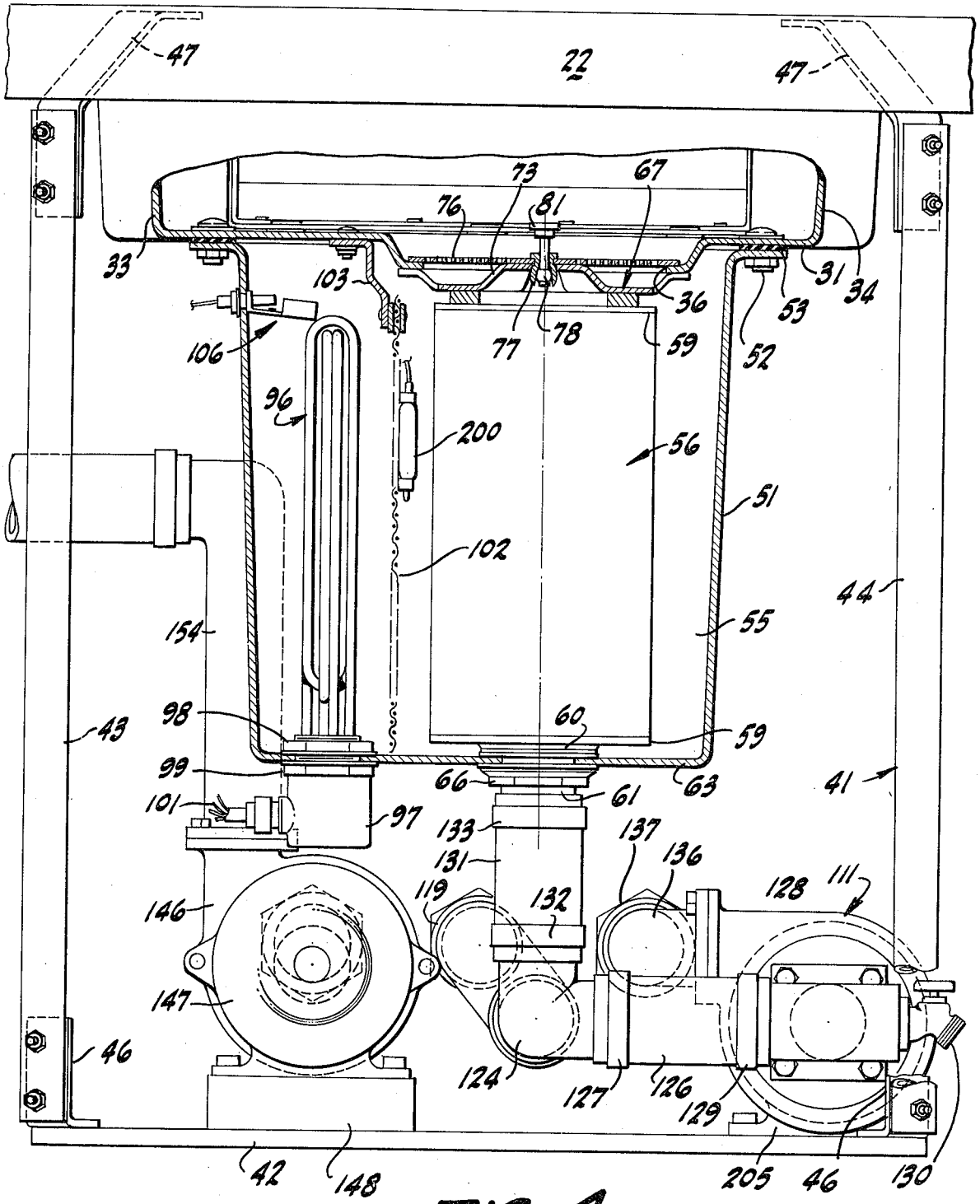
FIG. 4 is a cross-sectional view taken along the line 4—4 of FIG. 1.

A filter and heater housing 51 also formed of a fiber reinforced plastic is secured to the bottom wall 31 of the skimmer by suitable means such as bolts 52 (see FIG. 4). A gasket 53 is provided to form a liquid-tight seal. The filter and heater housing 51 is generally rectangular in shape when viewed in plan and is in communication with the opening 36 provided in the bottom wall 31. The housing 51 forms a well or cavity 55 which extends downwardly from the opening 36. A generally cylindrical filter element or cartridge 56 is disposed within the well 53. The filter cartridge is formed of a polyester fabric which has been pleated to provide a plurality of radially extending plates 57, the inner margins of which define an axially extending flow passage 58. End caps 59 formed of plastic are mounted over the ends of the pleats to complete the cartridge. The lower extremity of the filter element 56 is seated against a rubber seal 60 which is bonded to a suction fitting 61 that extends through the hole 62 provided in the bottom wall 63 of the housing 51. The suction fitting 61 is retained in the hole 62 by nuts 64 and 66 threaded onto the fitting 61 and engaging opposite sides of the bottom wall 63. The cartridge filter 56 is held in sealing engagement with the seal 60 by a filter locking disc 67 which carries an annular sealing gasket 68 that is adapted to engage the top of the filter cartridge 56. The filter locking disc 67 is provided with ears 69 which are adapted to be inserted through slots 71 provided in the bottom wall 31 of the skimmer 30 and which extends into the opening 36. The filter locking disc 67 is then further depressed so that the gasket 68 seats against the caps 59 of the cartridge filter 56 and is then rotated so that the ears underlie the bottom wall 31 and serve to retain the filter in place. The filter locking disc 67 is provided with a raised center portion 73 which is adapted to be grasped by hand to facilitate rotating the filter locking disc 67 and moving it between locked and unlocked positions.

A perforated strainer 76 formed of a suitable material such as plastic rests upon the bottom wall 31 and covers the central opening 36. It is secured to the filter locking disc 67 by a conventional locking assembly consisting of a grommet-like finger carrying member 77 which is adapted to be inserted through the strainer 76 and through the filter locking member 67. The member 77 is locked in a strainer retaining position by a spherical portion or ball 78 carried by a shaft 79. The shaft 79 carries a knob 81 which can be utilized for positioning the ball 78 so that the strainer 76 can be secured to the filter locking disc 67. When it is desired to remove the filter locking disc 67, the strainer 76 is removed to permit access to the raised center portion 73.

A movable weir 86 is provided at the forward extremity of the skimmer and is carried by a hinge 87 so as to permit the skimmer to pivot or swing between a generally upright position and a rearwardly inclined position. The weir 86 is in the form of a flat plate 88 which is curved at its upper and lower extremities and has secured to the rear side thereof a float member 89 formed of a suitable material such as a polystyrene foam material. Thus it can be seen that when the water level in the skimmer 30 is lowered, the upper edge of the weir will be lowered to permit the entrance of water from within the shell into the skimmer and conversely when the water level rises, the upper edge of the weir will be raised to inhibit the entry of additional water from the shell into the skimmer. The skimmer is provided with a cover plate 91 which is adapted to seat over the skimmer 30.

A dual element electric heater 96 is also disposed within the filter and heater housing 51 and is carried by a fitting 97 retained in the bottom wall by a pair of nuts 98 and 99 engaging opposite sides of the bottom wall 63. The heater 96 is connected by wires 101 to circuitry as hereinafter described. Means is provided within the filter and heater housing 51 for preventing accidental contact with the heater 96 during the time that the filter cartridge 56 is removed from the housing 51. This means consists of a planar screen 102 carried by bracket 103 secured to the bottom wall 31 of the skimmer 30 in such a manner so that the screen 102 depends downwardly from the bracket and extends between the heater 96 and the filter cartridge 56. A magnetic float switch assembly 106 is also provided in the filter and heater housing 51 adjacent the heater 96 and is provided to prevent operation of the heater unless there is an adequate water supply within the filter and heater housing 51.

Pump means is provided for removing water from the filter and heater housing 51 and consists of a pump 111 mounted upon the support member 42. The pump 111 has its inlet 112 connected by piping 113 to the outlet in the bottom of the filter and heater housing 51 and by piping 114 to a filter suction fitting 117 provided in the shell 11. The suction fitting 117 is secured to the side wall 14a of the shell 11 by nuts 118 and 119. The piping 114 consists of a flexible piece of tubing 121 secured by hose clamp 122 to the fitting 117 and by hose clamp 123 to one leg of a tee 124. One leg of the tee 124 is connected to one end of a hose 126 secured thereto by a hose clamp 127. The other end of the hose 126 is secured to an inlet fitting 128 by a hose clamp 129. The inlet tee 128 is coupled to the inlet 112 of the pump 111. A hose bib 130 is mounted in one leg of the tee 128 and can be used for draining the shell 11 and the filter and heater housing 51 and the associated piping. The remaining leg of the tee 124 is connected to tubing 131 by a hose clamp 132. The tubing 131 is also connected to the fitting 61 by a hose clamp 133. The outlet of the pump 111 is connected to a fitting 136 which is connected by tubing (not shown) to a filter return fitting 137. As shown in FIG. 10, the fitting 136 and the fitting 137 together with interconnecting tubing provides the piping 138 connecting the outlet of the pump 111 into the bottom of the shell 11.

In order to prevent the suction created by the pump 111 from preventing an undue force to be created so as to hold a human body or limb against the suction inlet in the shell 11, a suction break is provided which consists of piping 141 extending vertically from the piping 113 and connected into a check valve assembly 142 located below the rim 21. The check valve assembly 142 permits the entrance of air but prevents water from flowing outwardly through the same.

Additional pumping means for withdrawing water from within the shell 11 and for forming jets to provide hydrotherapy or hydromassage within the shell 11 is provided and consists of a pump 146 which is carried by an electric motor 147 mounted upon a mounting block 148 carried by the support member 42. The pump 146 is provided with inlet 151 which is coupled by piping 152 into a spa suction fitting 153. The outlet of the pump 146 is connected into a vertical riser pipe 154. The riser or pipe 154 is connected into a pipe 156 which extends around a substantial portion of the outer perimeter of the side wall portion 18. The pipe 156 is provided with a plurality of tees 157 which are connected into spa inlet fittings 158 that are mounted in the side wall 18 and are spaced circumferentially around the side wall 18 as shown particularly in FIG. 1. As shown therein, five of such spa inlets are provided. These connections from the outlet of the pump 146 to the spa inlet fittings have been identified as piping 159 in FIG. 10. A suction breakline 161 is provided which is connected into the inlet side of the pump 146 and is connected to a check valve 162 of the type heretofore described. Means is provided for admitting air into the piping 159 and consists of an air mix line 163 which opens underneath the rim 21 and admits air into the piping 159 so that it will be mixed with the water as it is discharged from the spa inlet fittings 158. As an alternative to the use of the suction break lines 141 and 161 an interconnection can be formed between the pump suction lines 114 and 152 by using a pipe 164 as shown in dotted lines in FIG. 10.

The isolated controls which are provided as a part of the spa construction include three control knobs 176, 177 and 178 and a temperature gauge 179 which are mounted on the front panel 29 to provide ready access to occupants or users within the spa and also to provide ready access outside of the spa. The control knob 176 controls a switch assembly 181 which is shown in detail in FIGS. 5 and 6. The switch assembly 181 is constructed in such a manner so as to provide electrical isolation for a purpose hereinafter described. The control knob 176 is mounted on a shaft 182. The shaft 182 is provided with a head 183. The shaft 182 extends through a plate 184 which is secured to the control panel surface 29 provided on the shell 11. The plate 184 is formed of a non-magnetic material. A spring washer 186 provides friction between the control knob 176 and the plate 184. A small magnet 187 is mounted within the control knob 176 and is rotatable with the control knob 176. The control knob 176 has three positions as shown in FIG. 6, namely "off," "filter only" and "on." For these three positions, the switch assembly 181 is provided with two encapsulated reed switches 188 and 189 which are adapted to be actuated by the magnet 187. The reed switches 188 and 189 are carried by a plate 191 also formed of a non-magnetic material and secured to the bottom side of the control panel portion of the shell by suitable means such as an adhesive. Thus it can be seen that in the "off" position of the control knob 176, neither of the reed switches 188 and 189 is actuated. In the "filter only" position, the reed switch 188 is actuated and in the "on" position the reed switch 189 is actuated.

The control knobs 177 and 178 are also provided with switch assemblies (not shown) which are similar to the switch assembly 181. The control knob 176 can be considered as the "system" control knob whereas the control knob 177 is the "spa" control knob having two positions "on" and "off." The third knob 178 is the heater control knob also a three-position switch having three positions "on," "off" and "high."

The control knobs 176, 177 and 178 are connected by wiring 192, 193 and 194 to a control console 196 supported upon the framework 41. The control console is provided with wiring 197 which can be connected to conventional residential wiring as for example 110 or 220 volt, 60 cycle a.c. Provided within the control console is a transformer (not shown) for reducing the voltage to a 12 volts a.c. control voltage that is supplied to the wiring 192, 193 and 194. The control console is provided with a high temperature safety cut-out 198, a low temperature thermostat 199 and a high temperature thermostat 201. The high temperature cut-out is connected to a temperature sensing bulb 200 mounted in the heater and filter housing 51. It is also provided with three circuit breakers, 202, 203 and 204 with circuit breakers 202 and 203 being for the 12 k.w. heaters 96 and the other circuit breaker 204 being for both of the pump motors 147 and 205. The circuitry is connected in such a way that in the event the circuit breaker 204 is actuated, power is cut off to the entire system. Relays of a suitable type are provided for controlling the heaters and the motors. Wiring 206 and 207 connects the control console 196 to the motor 205 and the motor 147. Wiring 208 connects the control console to the heaters 96.

Wiring 209 connects the control console 196 to the float safety switch 106 and serves to deenergize the heaters in the event there is insufficient water level within the filter and heater housing 51. As can be seen in FIG. 8, this float switch is provided with an encapsulated reed switch 211 which is adapted to be actuated by a magnet 212 carried by a lever arm 213 pivotally mounted upon a fitting 214. The lever arm carries a float 216. Thus it can be seen that when the water level is high enough, the float is raised to bring the magnet 212 into close proximity to the reed switch assembly 211 to cause the same to be closed and energizes a relay to permit operation of the heaters. In the event the water level in the filter and heater housing 51 drops below the level of the float switch assembly 106, the float 216 will drop to move the magnet 212 away from the reed switch assembly to permit it to open and to deenergize the relay to deenergize the heaters and thus preventing the heaters from burning out. A probe 218 is mounted in filter and heater housing 51 and is connected by a capillary tube 219 to the temperature gauge 179 so that there is provided at the control panel an indication of the water temperature within the spa.

Figure 11:
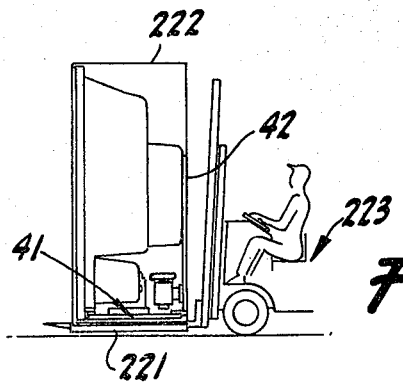
FIG. 11 is a side elevational view of the spa construction in a shipping mode.

In FIG. 11, the spa construction is shown in a shipping mode. As shown therein, there is provided an integrated wood pallet 221 which is secured to the framework 41 and in particular to the pipes 43 and 44. A corrugated carton 222 serves to enclose the spa construction together with its various components leaving the wood pallet exposed so that it can be engaged by a forklift truck 223 as shown in FIG. 11 and readily transported. It can be seen that the spa construction with its integral framework makes it possible to readily move the same by a forklift truck to facilitate loading of the same into railroad cars, trucks, vans and the like for shipment from one location to another. As for example with the construction provided, eleven units can be shipped in a forty foot semitrailer. After the spa has arrived at the location at which it is to be installed, the corrugated container can be readily removed and the wood pallet 221 can be removed from the framework 41.

After the spa and its construction have arrived at the site where it is to be utilized, it is only necessary for the contractor or owner to provide a pad as for example a concrete pad on which the spa can be mounted. This can be in the interior of a home or if desired, can be on the exterior of a home below or on a deck. Suitable decking can be then constructed around a spa construction so that it is generally flush with the top surface of the spa. Thereafter, it is only necessary for an electrical connection to be made to the control console 196 of the spa. The shell 11 can then be filled with water in a suitable manner such as by a garden hose. As soon as this has been accomplished, the spa is fully operational and ready to be enjoyed. From the foregoing, it can be seen that to install the spa it was unnecessary to provide any plumbing and it was unnecessary to install a gas line. In addition, it can be seen there was no fitting of multiple components. All of the components forming a part of the spa are shipped with the spa to provide a totally integrated package to simplify the installation of the spa and to minimize the cost of installation.

Operation of the spa is relatively simple. After it has been filled with water as hereinbefore described, the spa can be placed in operation by turning system control knob 176 to the "on" position which will cause operation of both the filter pump 111 and the heater 96. This will cause the water to be filtered and heated. (The water can be heated to the desired temperature by turning the heater control knob 178 to the "high" position which will heat the water to a desired temperature as for example a temperature of 105° F.) Turning the control knob 117 "on" will cause recirculation of the water to cause jets of air and water to be introduced through the outlets 158 provided in the side wall 18 of the spa for hydrotherapy. A user can readily enter the spa by stepping down onto the step 37, then down onto the seating area 16 and then into the well 14. Thereafter, the user or users can be seated on the contoured seat to enjoy the pleasurable sensations of the spa. A user while in the spa can operate the controls provided on the control panel 184 without danger. As pointed out hereinbefore, the controls are completely electrically isolated first by the magnetic switches hereinbefore described and secondly because only low control voltage 12 volts a.c. is utilized in the controls. Thus, dual safety is provided. In addition, the controls are located in such a position so that someone outside the spa can also readily operate the same.

When it is no longer desired to utilize the spa, the spa can be placed in a standby condition by operating the controls. For example, if it is desired to prevent freezing of the water within the spa, the heater control knob 178 can be turned to the "low" position which will maintain the temperature of the water at a suitable low temperature above freezing as for example 50° during the standby condition. If desired, the switch 176 can be operated so that only the filter pump 111 is operated. This makes it possible to maintain the water in the spa in the same manner as in a swimming pool. It is only necessary for the user to add the necessary chemicals at periodic intervals. Any floating material will be drawn into the skimmer 30 but will be prevented from entering the filter by the strainer 76. At periodic intervals, the cover 91 can be removed and the leaves and other debris cleaned out of the skimmer. The hinged weir 86 will prevent leaves and other debris from accidentally floating back into the main spa area. When it is desired to clean the filter, it is merely necessary to depress the knob 81 to release the strainer 76 to release the same. Thereafter, after removal of the strainer 76, the filter locking disc 67 can be rotated so that the ears 69 are brought into registration with the cut-outs 71 and to permit removal of the filter locking disc 67. Thereafter, the filter 56 can be lifted out of the filter and heater housing 51 and cleaned by spraying the same with water from a garden hose or the like. After it has been cleaned, it can be reinserted in the housing 51, the filter locking disc 67 and strainer 76 put in place in the manner hereinbefore described. It can be seen that there is adequate space between the filter locking disc 67 and the bottom wall of the skimmer to permit water to flow through the strainer and down to the filter where it can pass through itself and then through the flow passage 58 and thence into the filter pump.

From the foregoing it can be seen that there has been provided a spa construction which can be readily installed at a minimum expense. At the same time there has been provided a spa construction which can be readily used and maintained. In addition, a spa construction has been provided with numerous safety features to prevent harm to the user and to prevent accidential destruction of one or more of the components of the spa. Full operation including initiation of functions or modification of functions of the spa is possible from the interior or the exterior of the spa. Cleaning and servicing of the skimmer and filter is through the top of the spa. The various components utilized for the spa are formed integral with the shell of the spa which facilitates shipment and installation of the spa. This makes it possible for installation to be completed rapidly and readily with the only requirement being that electricity has to be provided for the spa.

Figure 12:
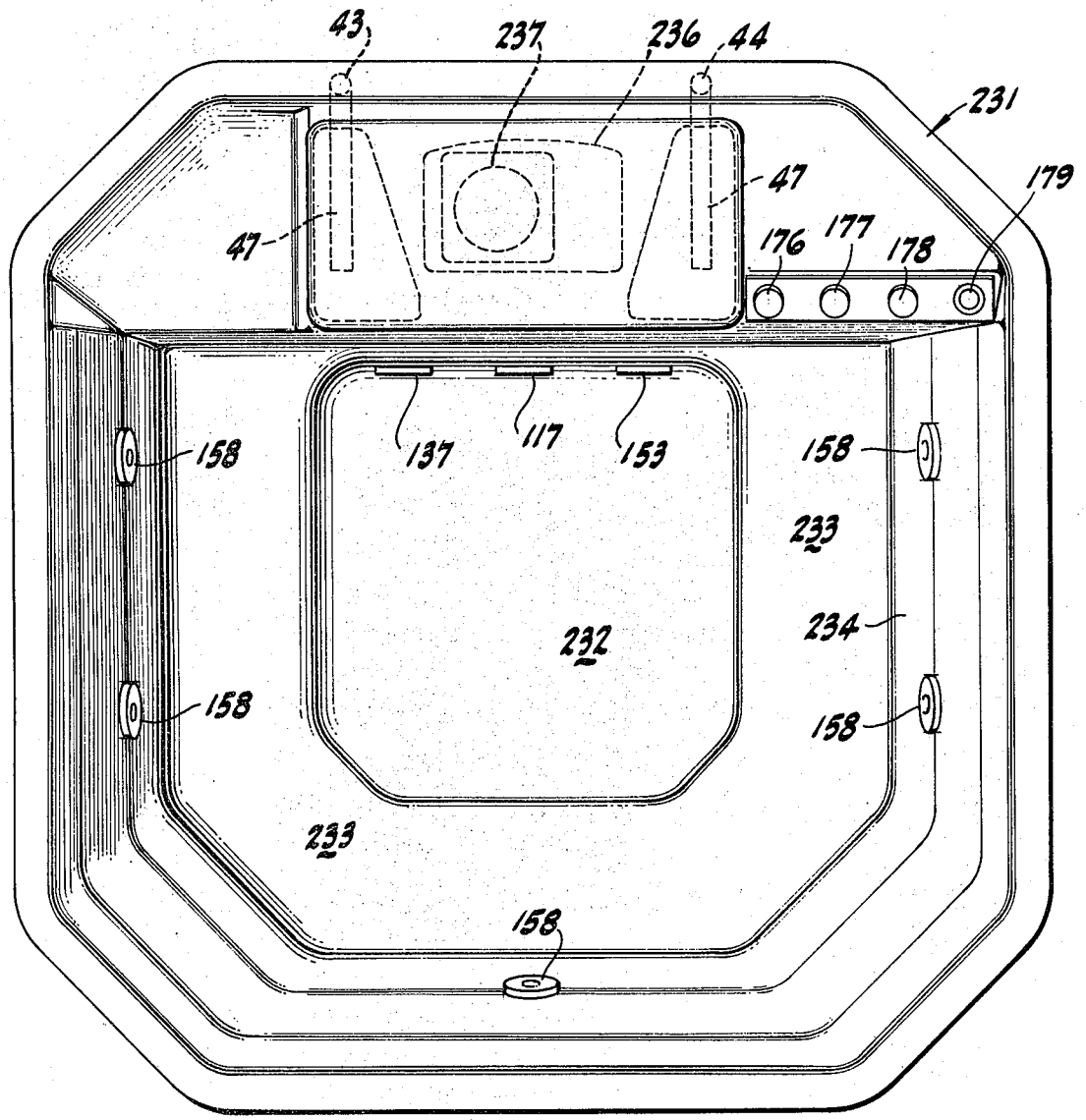
FIG. 12 is a top plan view of an alternative spa construction incorporating the present invention.

Another embodiment of the spa construction is shown in FIG. 12. As can be seen in this figure, the principal difference is in the configuration of the spa. In FIGS. 1–10, the configuration of the spa is generally circular whereas in FIG. 12, the configuration is generally rectangular. Thus, as shown in FIG. 12, the shell 231 is provided with a generally rectangular footwall 232, a generally U-shaped seating area 233 and a generally U-shaped side wall 234 which serves as a backrest to provide contoured seating of the same type as the embodiment shown in FIGS. 1–10. The remainder of the construction is substantially identical to that hereinbefore described with respect to the previous embodiment and includes a filter and heater housing 236 which is secured to the shell 231 and which has mounted therein a filter cartridge 237. The spa inlets 158 provided in the side wall 234 are identical to those hereinbefore described. Similarly the control knobs 176, 177 and 178 and the gauge 179 are identical to those hereinbefore described. The other remaining components of the spa construction are identical to those hereinbefore described. The operation and use of this embodiment of the spa construction is also identical to that hereinbefore described.

What is claimed is:

1. In a spa construction for use by humans, a shell for containing water and having a well for receiving the feet of the user, a seat area adjacent the well upon which the user can sit and a side wall area against which the user can rest his back, a filter and heater housing, a filter and a heater disposed within the housing, means for establishing communication between the shell and the filter and heater housing so that water can flow from within the shell into the filter and heater housing, pump means for withdrawing water from the filter and heater housing and for introducing the same into the shell after the water has passed through the filter and control means carried by the shell having controls which are accessible to a user while the user is within the shell for controlling the operation of the heater and the pump means, said heater and said pump means being electrically operated through said control means, said controls of said control means being electrically isolated from the remainder of the control means, and being free of any conductive path connecting the controls to the remainder of the control means, said shell is formed of an insultating material and said electrically isolated switch means includes first and second actuatable switching elements with the first of said actuatable switchinw elements being positioned on the underside of the shell and wherein said controls include the second actuatable switching element located on the upper side of the shell generally opposite the first switching element for causing operation of said first switching element.

2. A spa construction as in claim 1 wherein the remainder of said control means includes electrically isolated switch means.

3. A spa construction as in claim 2 wherein the remainder of said control means includes low voltage circuitry connected to said electrically isolated switch means.

4. A spa construction as in claim 2 wherein said first and second actuatable switching elements are magnets.

5. A spa construction as in claim 4 wherein said shell includes a panel formed within the shell and wherein said controls include at least one control knob carried by the panel and having mounted therein said second actuatable switching elements.

6. A span construction as in claim 1 together with a skimmer formed in said shell and overlying said filter and heater housing.

7. A spa construction as in claim 6 wherein said skimmer has a bottom wall and a side wall, said bottom wall having an opening therein overlying the filter and heater housing, said side wall having an opening therein in communication with the interior of the shell, a hinged weir in said opening and float means carried by said weir to cause the upper level of the weir to change its position in accordance with the level of water within the skimmer and a strainer overlying said opening and said heater and filter housing.

8. A spa construction as in claim 1 wherein said pump means includes a filter pump and a spa pump and wherein said filter pump has an inlet connected to the heater and filter housing and an outlet connected into the shell and wherein said spa pump has an inlet connected thereto the bottom of the shell and an outlet connected to the shell in a location above the bottom of the shell to provide jets of water for hydromassage within the spa and means for introducing air into the jets of water.

9. In a spa construction for use by humans, a shell for containing water and having a well for receiving the feet of the user, a seat area adjacent the well upon which the user can sit and a side wall area against which the user can rest his back, a filter and heater housing carried by the shell, a filter and a heater disposed within the housing, means for establishing communication between the shell and the filter and heater housing so that water can flow from within the shell into the filter and heater housing, pump means for withdrawing water from the filter and heater housing and for introducing the same into the shell after the water has passed through the filter, control means carried by the shell accessible to the user within the shell for controlling the heater and pump means, and a skimmer formed in said shell and overlying said filter and heater housing, said skimmer having a bottom wall and a side wall, said bottom wall having an opening therein overlying the filter and heater housing, said side wall having an opening therein in communication with the interior of the shell, a hinged weir in said opening float means carried by said weir to cause the upper level of the weir to change its position in accordance with the level of water within the skimmer and a strainer overlying said opening and said heater and filter housing, said filter element being insertable through the opening in the bottom of the skimmer and filter locking means engagable with the bottom wall of the skimmer for locking said filter element in place.

10. A spa construction as in claim 9 together with a screen disposed between the heater element and the filter element for preventing accidental contact with the heater while inserting or removing the filter cartridge.

11. In a spa construction for use by humans, a shell for containing water and having a well for receiving the feet of a user, a seat area adjacent the well upon which the user can sit and a side wall area against which the user can rest his back, a filter and heater housing carried by the shell, a skimmer formed in the shell and overlying the filter and heater housing, the skimmer having a bottom wall having an opening therein in communication with the filter and heater housing and having a side wall, a heater element disposed within the housing in a position spaced away from the opening in the bottom wall of the skimmer, a filter element disposed within the housing immediately below the opening in the bottom wall of the skimmer, filter retaining means engaging the bottom wall of the skimmer for retaining the filter element within the filter and heater housing, a screen disposed between the heater element and the filter element to prevent accidental contact with the heater element and pump means for withdrawing water from the filter and heater housing and for introducing the same into the shell after water has passed into the filter.

12. A spa construction as in claim 11 together with a hinged wall mounted in said opening in the side wall of the skimmer and float means carried by the weir to cause the upper level of the weir to change its position in accordance with the level of water in the skimmer and a strainer overlying the opening in said bottom wall.

13. A spa construction as in claim 12 together with a removable cover mounted on said shell to cover said skimmer.

14. In a spa construction for use by humans, a shell containing water and having a well for receiving the feet of a user, a seat adjacent the well upon which the user can sit and a side wall against which the user can rest his back, a filter housing carried by the shell, a skimmer formed in the shell, and overlying the filter and heater housing, the skimmer having a bottom wall with opening therein in communication with the filter and heater housing and having a side wall, a heater disposed within the housing in a position spaced away from the opening of the bottom wall of the skimmer, a filter disposed within the housing means below the opening of the bottom wall of the skimmer, filter retaining means engaging the bottom wall of the skimmer for retaining the filter element within the filter and heater housing, means for preventing accidental contact with the heater by access through the opening in the bottom wall of the skimmer and pump means for withdrawing water from the heater and heater housing and introducing the same into the shell after the water has passed through the filter.

* * * * *